US008498806B2

(12) United States Patent
Fukano et al.

(10) Patent No.: US 8,498,806 B2
(45) Date of Patent: Jul. 30, 2013

(54) HYDRAULIC SHOVEL POSITIONAL GUIDANCE SYSTEM AND METHOD OF CONTROLLING SAME

(75) Inventors: Ryo Fukano, Yokohama (JP); Etsuo Fujita, Hirakata (JP); Masao Ando, Oita (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/819,248

(22) PCT Filed: Feb. 8, 2012

(86) PCT No.: PCT/JP2012/052831

§ 371 (c)(1),
(2), (4) Date: Feb. 26, 2013

(87) PCT Pub. No.: WO2012/114871

PCT Pub. Date: Aug. 30, 2012

(65) Prior Publication Data

US 2013/0158785 A1 Jun. 20, 2013

(30) Foreign Application Priority Data

Feb. 22, 2011 (JP) ..... 2011-036200

(51) Int. Cl.
*G01C 21/00* (2006.01)

(52) U.S. Cl.
USPC ..... 701/408; 701/423; 701/435; 701/301; 701/23; 701/26; 701/412

(58) Field of Classification Search
USPC ..... 701/408, 435
See application file for complete search history.

(56) References Cited

U.S. PATENT DOCUMENTS

| | | | | |
|---|---|---|---|---|
| 2001/0021888 | A1 * | 9/2001 | Burns et al. | 701/23 |
| 2009/0062971 | A1 * | 3/2009 | Rottig et al. | 701/2 |
| 2010/0153010 | A1 * | 6/2010 | Huang | 701/210 |
| 2013/0054133 | A1 * | 2/2013 | Lewis et al. | 701/423 |

FOREIGN PATENT DOCUMENTS

| | | | |
|---|---|---|---|
| JP | 2001-98585 | A | 4/2001 |
| JP | 2004-68433 | A | 3/2004 |
| JP | 2006-214246 | A | 8/2006 |
| WO | 2004/027164 | A1 | 4/2004 |

OTHER PUBLICATIONS

International Search Report of corresponding PCT Application No. PCT/JP2012/052831.

* cited by examiner

*Primary Examiner* — Redhwan K Mawari
(74) *Attorney, Agent, or Firm* — Global IP Counselors, LLP

(57) ABSTRACT

In a hydraulic shovel positional guidance system, an optimal work position calculation unit is configured to calculate an optimal work position of a main vehicle body where a diggable range in which a target surface and an operability range overlap is largest. A display unit is configured to display a guidance picture showing the optimal work position.

11 Claims, 16 Drawing Sheets

| TITLE | THIRD ARC (A3) |
|---|---|
| BOOM ANGLE | MINIMUM ↔ MAXIMUM |
| ARM ANGLE | MAXIMUM |
| BUCKET ANGLE | MINIMUM REACH ANGLE |

| TITLE | SECOND ARC (A2) |
|---|---|
| BOOM ANGLE | MAXIMUM |
| ARM ANGLE | MINIMUM ↔ MAXIMUM |
| BUCKET ANGLE | 0° |

| TITLE | FOURTH ARC (A4) |
|---|---|
| BOOM ANGLE | MINIMUM |
| ARM ANGLE | MINIMUM ↔ MAXIMUM |
| BUCKET ANGLE | 0° |

| TITLE | FIRST ARC (A1) |
|---|---|
| BOOM ANGLE | MINIMUM ↔ MAXIMUM |
| ARM ANGLE | MINIMUM |
| BUCKET ANGLE | MAXIMUM REACH ANGLE |

HYDRAULIC SHOVEL POSITIONAL GUIDANCE SYSTEM AND METHOD OF CONTROLLING SAME

CROSS-REFERENCE TO RELATED APPLICATIONS

This application claims priority to Japanese Patent Application No. 2011-036200 filed on Feb. 22, 2011, the disclosure of which is hereby incorporated herein by reference in its entirety.

TECHNICAL FIELD

The present invention relates to a hydraulic shovel positional guidance system and a method for controlling same.

BACKGROUND ART

A positional guidance system for guiding a hydraulic shovel or other work vehicle to a target work object is known. For example, the positional guidance system disclosed in Japanese Laid-open Patent Application Publication 2001-98585 has design data showing a three-dimensional design land shape. The design land shape comprises a plurality of design surfaces, and part of the design surfaces is selected as a target surface. The current position of the hydraulic shovel is detected using position measuring means such as a GPS. The positional guidance system displays a guidance picture showing the current position of the hydraulic shovel on a display unit, thereby guiding the hydraulic shovel to the target surface. The guidance picture includes the hydraulic shovel as seen in side view, the target surface, and the range of motion of the tip of a bucket.

SUMMARY

In the positional guidance system described above, an operator is capable of referring to the positional relationship of the target surface and the range of motion of the tip of the bucket in the guidance picture when it is decided whether the hydraulic shovel is in a position suitable for performing work. However, it is not easy to accurately decide whether the hydraulic shovel is in a position suitable for performing work. Additionally, it is not easy to move the hydraulic shovel to a position suitable for performing work even when referring to the positional relationship of the target surface and the range of motion of the tip of the bucket in the guidance picture.

An object of the present invention is to provide a hydraulic shovel positional guidance system and a method of controlling the same allowing a hydraulic shovel to be easily moved to a position suitable for work.

A hydraulic shovel positional guidance system according to a first aspect of the present invention is a positional guidance system for guiding a hydraulic shovel to a target surface within a work area. The hydraulic shovel has a main vehicle body and a work machine attached to the main vehicle body. The positional guidance system comprises a land shape data storage unit, a work machine data storage unit, a position detector unit, an optimal work position calculation unit, and a display unit. The land shape data storage unit stores land shape data indicating a position of the target surface. The work machine data storage unit stores work machine data. The work machine data indicates the operability range in the area around the vehicle body which the work machine is capable of reaching. The position detector unit detects a current position of the main vehicle body. The optimal work position calculation unit calculates, as an optimal work position, a position of the main vehicle body where the diggable range, in which the target surface and the operability range overlap, is largest, based on the land shape data, the work machine data, and the current position of the main vehicle body. The display unit displays a guidance picture showing the optimal work position.

A hydraulic shovel positional guidance system according to a second aspect of the present invention is the hydraulic shovel positional guidance system according to the first aspect, wherein the diggable range is a portion in which the operability range and a line showing the cross section of the target surface overlap as seen from the side.

A hydraulic shovel positional guidance system according to a third aspect of the present invention is the hydraulic shovel positional guidance system according to the first aspect, wherein the guidance picture includes a side view showing the cross section of the target surface, the hydraulic shovel, and the optimal work position as seen from the side.

A hydraulic shovel positional guidance system according to a fourth aspect of the present invention is the hydraulic shovel positional guidance system according to the first aspect, wherein the guidance picture includes a top view showing the target surface, the hydraulic shovel, and the optimal work position as seen from above.

A hydraulic shovel positional guidance system according to a fifth aspect of the present invention is the hydraulic shovel positional guidance system according to the first aspect, further comprising a current surface detection unit and a current surface storage unit. The current surface detection unit detects the latest current surface. The current surface storage unit stores and updates the latest current surface detected by the current surface detection unit. The optimal work position is calculated based on the height of the operability range as the main vehicle body is positioned on the current surface.

A hydraulic shovel positional guidance system according to a sixth aspect of the present invention is the hydraulic shovel positional guidance system according to the first aspect, further comprising a current surface detection unit and a current surface storage unit. The current surface detection unit detects the latest current surface. The current surface storage unit stores and updates the latest current surface detected by the current surface detection unit. The optimal work position calculation unit classifies the target surface into dug area and undug area based on a degree of a gap between the current surface and the target surface. The optimal work position calculation unit sets the undug area nearest the main vehicle body as the object of the diggable range.

A hydraulic shovel positional guidance system according to a seventh aspect of the present invention is the hydraulic shovel positional guidance system according to the first aspect, wherein the optimal work position calculation unit causes the guidance picture to show the optimal work position when the angle of inclination of the current surface or the target surface is equal to or more than a preset threshold value.

A hydraulic shovel positional guidance system according to an eighth aspect of the present invention is the hydraulic shovel positional guidance system according to the first aspect, wherein the optimal work position is a position such that, when the target surface is an upward slope or a level surface as seen from the hydraulic shovel, the farthest intersection from the main vehicle body among the intersections of the boundary of the operability range and the target surface corresponds to the top of the target surface.

A hydraulic shovel positional guidance system according to an ninth aspect of the present invention is the hydraulic shovel positional guidance system according to the first aspect, wherein the optimal work position is a position such that, when the target surface is a downward slope as seen from the hydraulic shovel, the nearest intersection to the main vehicle body among the intersections of the boundary of the operability range and the target surface corresponds to the top of the target surface.

A hydraulic shovel according to a tenth aspect of the present invention comprises the hydraulic shovel positional guidance system according to any of claims 1 through 9.

A method for controlling a hydraulic shovel positional guidance system according to an eleventh aspect of the present invention is a method for controlling a positional guidance system for guiding a hydraulic shovel to a target surface within a cork area. The hydraulic shovel has a main vehicle body and a work machine attached to the main vehicle body. The method for controlling the hydraulic shovel positional guidance system comprises the following steps. In the first step, a current position of the main vehicle body is detected. In the second step, a position of the main vehicle body where a diggable range, in which the target surface and the operability range overlap, is largest is calculated as the op mat work position based on land shape data, work machine data, and the current position of the main vehicle body. The land shape data indicates the position of the target surface. The work machine data indicates the operability range in the area around the main vehicle body which the work machine is capable of reaching. In the third step, a guidance picture showing the optimal work position is displayed.

In the hydraulic shovel positional guidance system according to the first aspect of the present invention, the position of the main vehicle body where the diggable range, in which the target surface and the operability range overlap, is largest is calculated as the optimal work position. The guidance picture showing the optimal work position is then displayed on the display unit. Accordingly, an operator can easily move the hydraulic shovel to a position suitable for performing work by moving the hydraulic shovel towards the optimal work position shown in the guidance picture.

In the hydraulic shovel positional guidance system according to the second aspect of the present invention, the position where the range on the target surface which can be reached by the work machine as seen from the side is largest is calculated as the optimal work position. An operator is thus capable of performing work efficiently by operating the work machine at the optimal work position.

In the hydraulic shovel positional guidance system according to the third aspect of the present invention, an operator can find the optimal work position using the side view. Thus, an operator can easily adjust the forward/backward position of the hydraulic shovel.

In the hydraulic shovel positional guidance system according to the fourth aspect of the present invention, an operator can find the optimal work position using the top view. Thus, an operator can easily adjust the left/right position of the hydraulic shovel.

In the hydraulic shovel positional guidance system according to the fifth aspect of the present invention, the optimal work position is calculated based the height of the operability range as the main vehicle body is positioned on the current surface. The ground within the work area is not always flat, and is often rough. Thus, the height of the main vehicle body when at a position apart from the target surface and the height of the main vehicle body after having subsequently moved near the target surface may differ. It is therefore difficult to precisely calculate the optimal work position if the optimal work position is calculated based on the height of the operability range at the current position of the main vehicle body. Thus in the hydraulic shovel positional guidance system according to the present aspect, the optimal work position is calculated based on the height of the operability range as the main vehicle body is positioned on the current surface even when calculating the optimal work position at a position apart from the target surface. It is thereby possible to precisely calculate the optimal work position even in a rough work area.

In the hydraulic shovel positional guidance system according to the sixth aspect of the present invention, even when a undug area and a dug area are mixed due to intermittent digging, the dug area, which no longer needs to be dug, is excluded when the optimal work position is calculated. It is thereby possible to precisely calculate an effective optimal work position.

In the hydraulic shovel positional guidance system according to a seventh aspect of the present invention, the optimal work position is not displayed in the guidance picture when the angle of inclination of the current surface or the target surface is equal to or more than a preset threshold value. For example, the preset threshold value is set to a slope angle indicating the limit at which the hydraulic shovel is capable of stably performing work. It is thereby possible to show in the guidance picture an optimal work position within the range where the hydraulic shovel is capable of stably performing work.

In the hydraulic shovel positional guidance system according to the eighth aspect of the present invention, a position where the work machine can extend to reach the top of the target surface is calculated as the optimal work position when the target surface is an upward slope or a level surface as seen from the hydraulic shovel. An operator is thereby capable of operating the hydraulic shovel so as, for example, to descend the upward slope while digging is performed downwards from the top, when an upward slope is much larger than the hydraulic shovel.

In the hydraulic shovel positional guidance system according to the ninth aspect of the present invention, a position where the work machine can retract to reach the top of the target surface is calculated as the optimal work position when the target surface is a downward slope as seen from the hydraulic shovel. An operator is thereby capable of operating the hydraulic shovel so as, for example, to descend the downward slope while digging the area in front of the main vehicle body.

In the hydraulic shovel positional guidance system according to the tenth aspect of the present invention, the position of the main vehicle body where the diggable range, in which the target surface and the operability range overlap, is largest is calculated as the optimal work position. The guidance picture showing the optimal work position is then displayed on the display unit. Accordingly, an operator can easily move the hydraulic shovel to a position suitable for performing work by moving the hydraulic shovel towards the optimal work position shown in the guidance picture.

In the hydraulic shovel positional guidance system according to the eleventh aspect of the present invention, the position of the main vehicle body where the diggable range, in which the target surface and the operability range overlap, is largest is calculated as the optimal work position. A guidance picture showing the optimal work position is then displayed on the display unit. Accordingly, an operator can easily move the hydraulic shovel to a position suitable for performing work by moving the hydraulic shovel towards the optimal work position shown in the guidance picture.

DETAILED DESCRIPTION OF EMBODIMENTS

1. Configuration

1-1. Overall Configuration of Hydraulic Shovel

Figure 1:
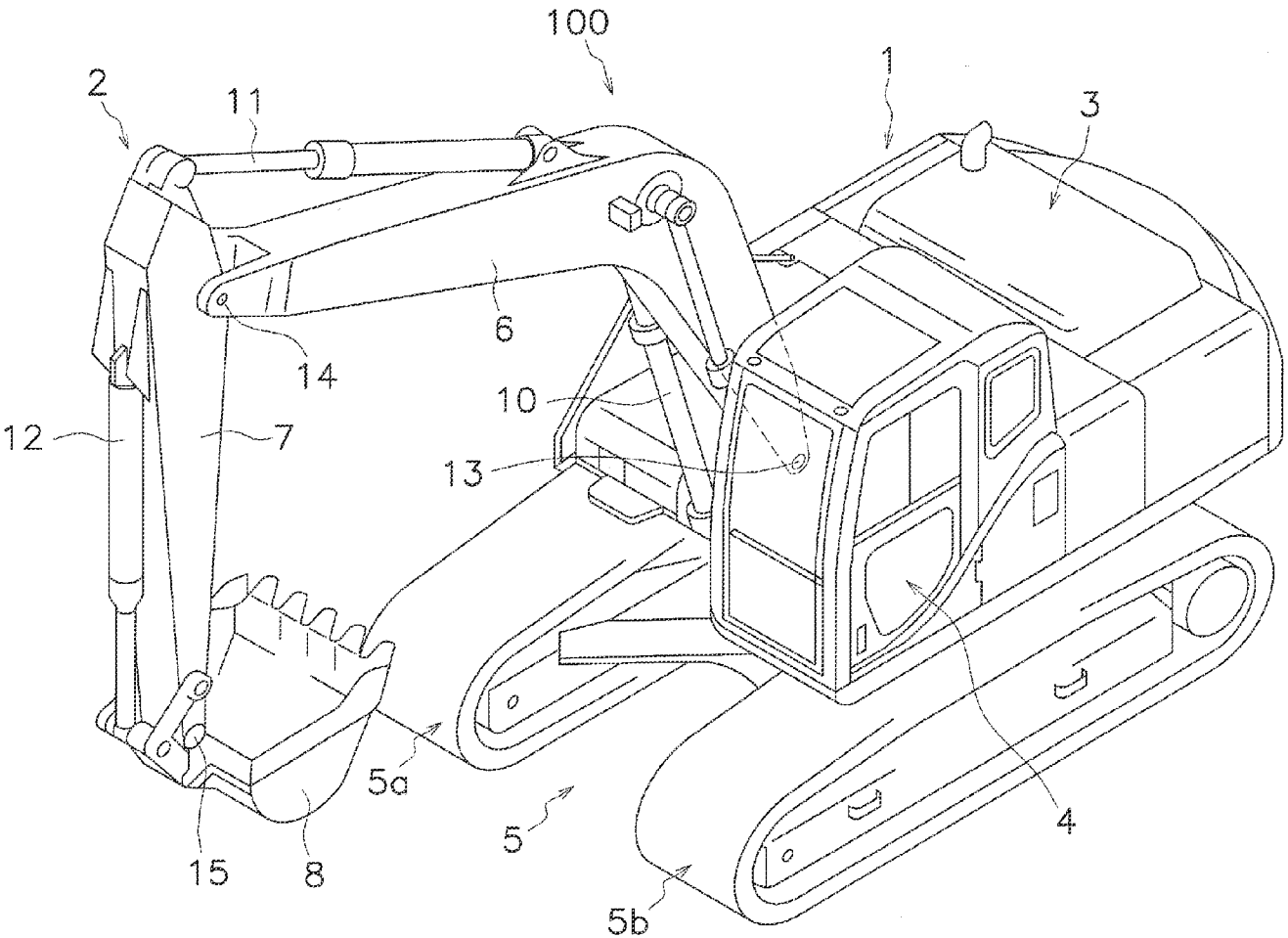
FIG. 1 is a perspective view of a hydraulic shovel.

There follows a description of a hydraulic shovel positional guidance system according to an embodiment of the present invention with reference to the drawings. FIG. 1 is a perspective view of a hydraulic shovel 100 in which a positional guidance system is installed. The hydraulic shovel 100 has a main vehicle body 1 and a work machine 2. The main vehicle body 1 has an upper pivoting body 3, a cab 4, and a travel unit 5. The upper pivoting body 3 includes devices, such as an engine, a hydraulic pump, and/or the like, which are not shown in the drawings. The cab 4 is installed on the front of the upper pivoting body 3. A display input device 38 and an operating device 25 described below are disposed within the cab 4 (cf. FIG. 3). The travel unit 5 has tracks 5*a*, 5*b*, and the rotation of the tracks 5*a*, 5*b* causes the hydraulic shovel 100 to travel.

The work machine 2 is attached to the front of the main vehicle body 1, and has a boom 6, an arm 7, a bucket 8, a boom cylinder 10, an arm cylinder 11, and a bucket cylinder 12. The base end of the boom 6 is pivotally attached to the front of the main vehicle body 1 with a boom pin 13 disposed therebetween. The base end of the arm 7 is pivotally attached to the tip of the boom 6 with an arm pin 14 disposed therebetween. The tip of the arm 7 is pivotally attached to the bucket 8 with a bucket pin 15 disposed therebetween.

Figure 2:
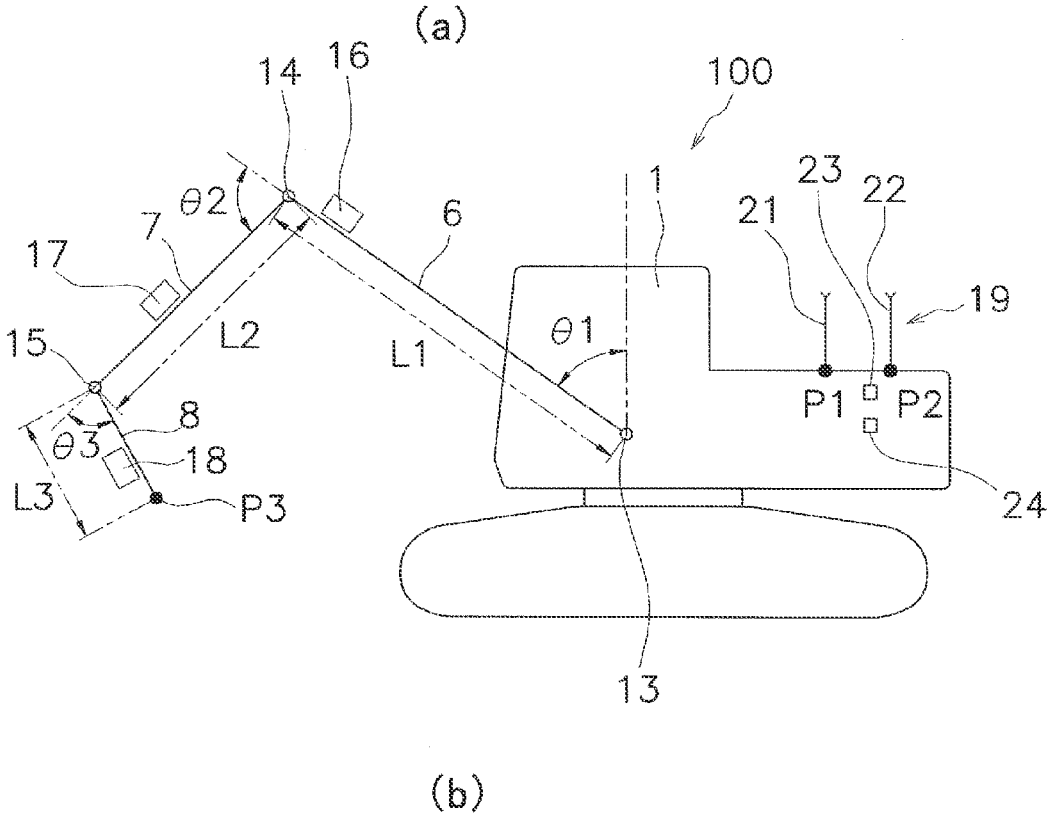
FIG. 2 is a schematic illustration of the configuration of the hydraulic shovel.

FIG. 2 is a schematic illustration of the configuration of the hydraulic shovel 100. FIG. 2(*a*) is a side view of the hydraulic shovel 100, and FIG. 2(*b*) is a rear view of the hydraulic shovel 100. As shown in FIG. 2(*a*), L1 is the length of the boom 6, i.e., the length from the boom pin 13 to the arm pin 14. L2 is the length of the arm 7, i.e., the length from the arm pin 14 to the bucket pin 15. L3 is the length of the bucket 8, i.e., the length from the bucket pin 15 to the tip of a tooth of the bucket 8.

The boom cylinder 10, arm cylinder 11, and bucket cylinder 12 shown in FIG. 1 are hydraulic cylinders, each of which is driven by hydraulic pressure. The boom cylinder 10 drives the boom 6. The arm cylinder 11 drives the arm 7. The bucket cylinder 12 drives the bucket 8. A proportional control valve 37 (cf. FIG. 3) is disposed between a hydraulic pump not shown in the drawings and the hydraulic cylinders of the boom cylinder 10, arm cylinder 11, bucket cylinder 12, and the like. The proportional control valve 37 is controlled by a work machine controller 26 described below, whereby the flow rate of hydraulic oil supplied to the hydraulic cylinders 10 to 12 is controlled. In this way, the movements of the hydraulic cylinders 10 to 12 are controlled.

As shown in FIG. 2(*a*), the boom 6, arm 7, and bucket 8 are provided with first through third stroke sensors 16 to 18, respectively. The first stroke sensor 16 detects the stroke length of the boom cylinder 10. A positional guidance controller 39 (cf. FIG. 3) described below calculates an angle of inclination (hereafter, "boom angle") θ1 of the boom 6 with respect to an axis Za (cf. FIG. 6) in a main vehicle body coordinate system described below using the stroke length of the boom cylinder 10 detected by the first stroke sensor 16. The second stroke sensor 17 detects the stroke length of the arm cylinder 11. The positional guidance controller 39 calculates an angle of inclination (hereafter, "arm angle") θ2 of the arm 7 with respect to the boom 6 using the stroke length of the arm cylinder 11 detected by the second stroke sensor 17. The third stroke sensor 18 detects the stroke length of the bucket cylinder 12. The positional guidance controller 39 calculates an angle of inclination. (hereafter, "bucket angle") θ3 of the bucket 8 with respect to the arm 7 using the stroke length of the bucket cylinder 12 detected by the third stroke sensor 18.

The main vehicle body 1 is provided with a position detector unit 19. The position detector unit 19 detects the current position of the hydraulic shovel 100. The position detector unit 19 has two Real Time Kinematic Global Navigation Satellite System (RTK-GNSS) antennas 21, 22 (hereafter, "GNSS antennas 21, 22"), a three-dimensional position sensor 23, and an inclination angle sensor 24. The GNSS antennas 21, 22 are disposed at a fixed interval along a Ya axis (cf. FIG. 6) of a main vehicle body coordinate system Xa-Ya-Za described below. Signals corresponding to GNSS radio waves received by the GNSS antennas 21, 22 are inputted to the three-dimensional position sensor 23. The three-dimensional position sensor 23 detects mounting positions P1, P2 of the GNSS antennas 21, 22. As shown in FIG. 2(*b*), the inclination angle sensor 24 detects an angle of inclination θ4 (hereafter, "roll angle θ") of the widthwise direction of the main vehicle body 1 with respect to the direction of gravity, i.e., the vertical direction in the global coordinate system.

Figure 3:
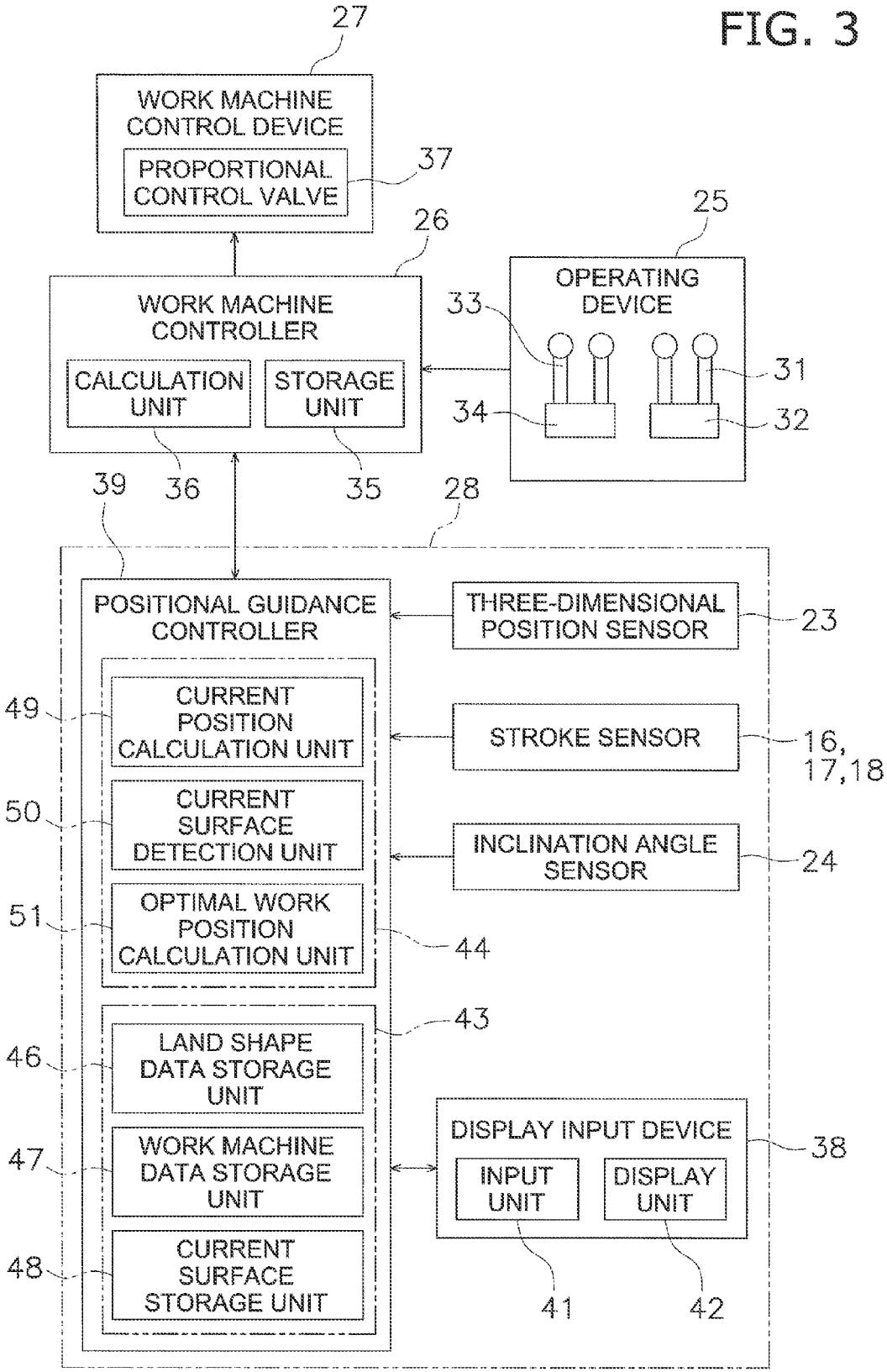
FIG. 3 is a block diagram showing the configuration of a control system which a hydraulic shovel comprises.

FIG. 3 is a block diagram of the configuration of a control system which the hydraulic shovel 100 comprises. The hydraulic shovel 100 comprises the operating device 25, the work machine controller 26, a work machine control device 27, and a positional guidance system 28. The operating device 25 has a work machine operating member 31, a work machine operation detector unit 32, a travel operating member 33, and a travel operation detector unit 34. The work machine operating member 31 is a member for allowing an operator to operate the work machine 2, and is, for example, an operating lever. The work machine operation detector unit 32 detects the details of the operation inputted by using the work machine operating member 31, and sends the details to the work machine controller 26 as a detection signal. The travel operating member 33 is a member for allowing an operator to operate the traveling of the hydraulic shovel 100, and is, for example, an operating lever. The travel operation detector unit 34 detects the details of the operation inputted by using the travel operating member 33, and sends the details to the work machine controller 26 as a detection signal.

The work machine controller 26 has a storage unit 35 such as a RAM or ROM, and a calculation unit 36 such as a CPU. The work machine controller 26 primarily controls the work machine 2. The work machine controller 26 generates a control signal for causing the work machine 2 to act according to the operation of the work machine operating member 31, and outputs the signal to the work machine control device 27. The work machine control device 27 has the proportional control valve 37, and the proportional control valve 37 is controlled based on the control signal from the work machine controller 26. Hydraulic oil is drained from the proportional control valve 37 at a flow rate corresponding to the control signal from the work machine controller 26, and is supplied to the hydraulic cylinders 10 to 12. The hydraulic cylinders 10 to 12 are driven according to the hydraulic oil supplied from the proportional control valve 37. This causes the work machine 2 to act.

1-2. Configuration of Positional Guidance System 28

The positional guidance system 28 is a system for guiding the hydraulic shovel 100 to a target surface within the work area. Along with the first through third stroke sensors 16 to 18, the three-dimensional position sensor 23, and the inclination angle sensor 24 described above, the positional guidance system 28 has the display input device 38 and the positional guidance controller 39.

The display input device 38 has an input unit 41 like a touch panel, and a display unit 42 such as an LCD. The display input device 38 displays a guidance picture for guiding the hydraulic shovel 100 to a target work object within a work area. A variety of keys are displayed on the guide screen. An operator can execute the variety of functions of the positional guidance system 28 by touching the variety of keys in the guidance picture. The guidance picture will be described in detail later.

The positional guidance controller 39 executes the various functions of the positional guidance system 28. The positional guidance controller 39 and the work machine controller 26 are capable of communicating with each other via wired or wireless communication means. The positional guidance controller 39 has a storage unit 43 such as a RAM and/or a ROM, and a calculation unit 44 such as a CPU.

Figure 4:
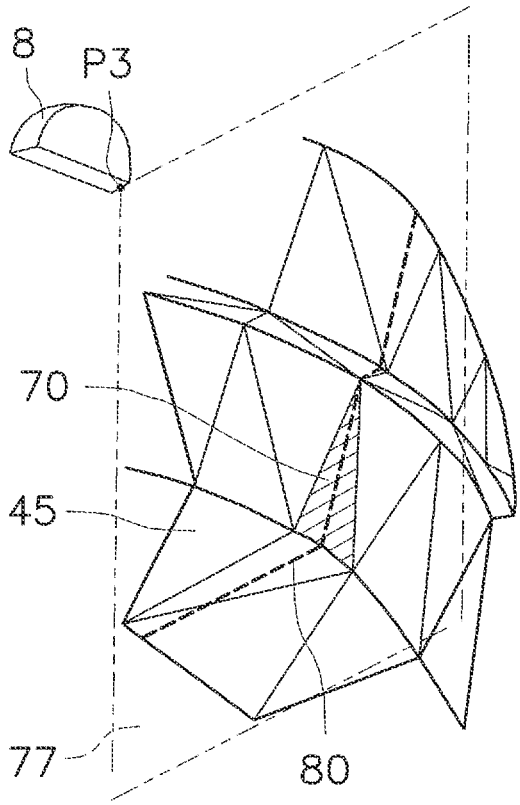
FIG. 4 is an illustration of a design land shape indicated by design land shape data.

The storage unit 43 stores data necessary for various processes executed by the calculation unit 44. The storage unit 43 has a land shape data storage unit 46, a work machine data storage unit 47, and a current surface storage unit 48. Design land shape data is created in advance and stored in the land shape data storage unit 46. The design land shape data indicates the shape and position of a three-dimensional design topography in the work area. Specifically, as shown in FIG. 4, the design land shape includes a plurality of design surfaces 45, each of which is rented using a triangular polygon. In FIG. 4, only one of the plurality of design surfaces is labeled 45, while labels for the other design surfaces are omitted. The operator selects one or a plurality of design surfaces among the design surfaces 45 as a target surface 70.

The work machine data storage unit 47 stores work machine data. The work machine data is data indicating an operability range 76 of the circumference around the main vehicle body 1 that can be reached by the work machine 2 (cf. FIG. 5). The cork machine data comprises the length L1 of the boom 6, the length L2 of the arm 7, and the length L2 of the bucket 8 described above. The work machine data also comprises minimum values and maximum values for each of the boom angle θ1, the arm angle θ2, and the bucket angle θ3.

The current surface storage unit 48 stores current surface data. The current surface data is data indicating a current surface (cf. label 78 in FIG. 5) detected by a current surface detection unit 50 described below. The current surface indicates the current actual land shape. The current surface detection unit 50 repeatedly detects the current surface every time a predetermined amount of time passes. The current surface storage unit 48 updates the current surface data to data indicating the latest current surface detected by the current surface detection unit 50.

The calculation unit 44 has a current position calculation unit 49, the current surface detection unit 50, and an optimal work position calculation unit 51. The current position calculation unit 49 detects the current position of the main vehicle body 1 in the global coordinate system based on the detection signal from the position detector unit 19. The current position calculation unit 49 also calculates the current position of the tip of the bucket 8 in the global coordinate system based on the current position of the main vehicle body 1 in the global coordinate system and the work machine data described above. The current surface detection unit 50 detects the latest current surface. The optimal work position calculation unit 51 calculates the optimal work position based on the design land shape data, the work machine data, and the current position of the main vehicle body 1. The optimal work position indicates the optimal position of the main vehicle body 1 to perform digging on the target surface 70. The method of calculating the current position of the tip of the bucket 8, the method of detecting the current surface, and the method of calculating the optimal work position will be described in detail hereafter.

The positional guidance controller 39 causes the display input device 38 to display a guidance picture based on the results calculated by the current position calculation unit 49, the current surface detection unit 50, and the optimal work position calculation unit 51. The guidance picture is a picture for guiding the hydraulic shovel 100 to the target surface 70. Hereafter follows a detailed description of the guidance picture.

2. Guidance picture 2-1. Configuration of Guidance Picture

Figure 5:
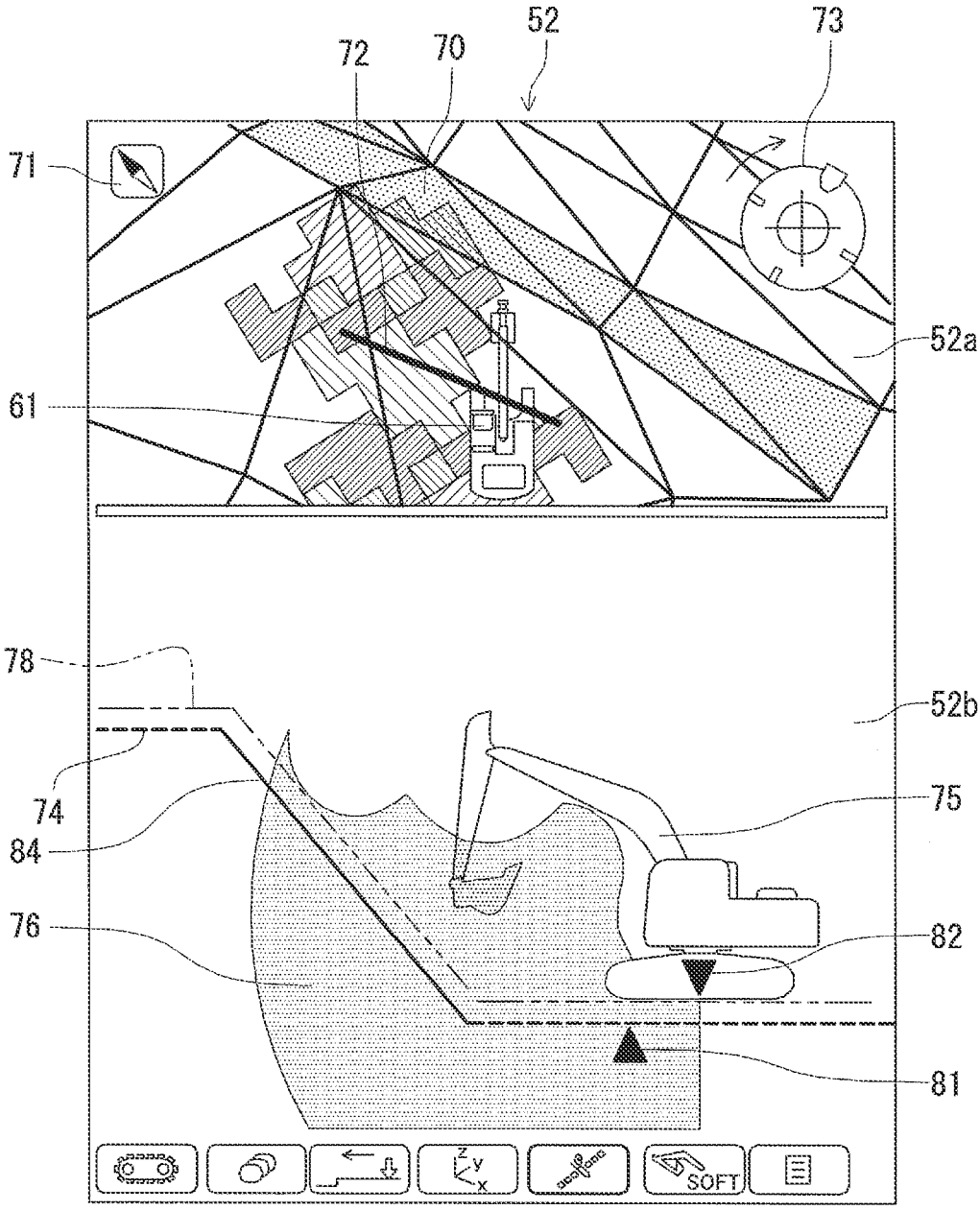
FIG. 5 is an illustration of a guidance picture.

A guidance picture 52 is shown in FIG. 5. The guidance picture 52 includes a top view 52*a* and a side view 52*b*.

The top view 52*a* illustrates the design land shape of the work area and the current position of the hydraulic shovel 100. The top view 52*a* represents the design land shape as seen from above using a plurality of triangular polygons. The target surface 70 is displayed in a color different from that of the rest of the design surface. In FIG. 5, the current position of the hydraulic shovel 100 is displayed as an icon 61 of the hydraulic shovel as seen from above, but another symbol may be displayed to indicate the current position.

In the top view 52*a*, information for guiding the hydraulic shovel 100 to the target surface 70 is displayed. Specifically, a directional indicator 71 is displayed. The directional indicator 71 is an icon for showing the direction of the target surface 70 with respect to the hydraulic shovel 100. The top view 52*a* further includes information showing an optimal work position and information for bringing the hydraulic shovel 100 directly face-to-face with the target surface 70. The optimal work position is the optimal position for the hydraulic shovel 100 to perform digging upon the target surface 70, and is calculated on the basis of the position of the target surface 70 and an operability range 76 to be described hereafter. The optimal work position is displayed as a straight line 72 in the top view 52*a*. The information for bringing the hydraulic shovel 100 directly face-to-face with the target surface 70 is displayed as a facing compass 73. The facing compass 73 is an icon showing the direction directly facing the target surface 70 and the direction of the hydraulic shovel 100 to pivot in. The operator can find the degree to which the shovel faces the target surface 70 using the facing compass 73.

The side view 52*b* includes the design surface line 74, the current surface line 78, a target surface line 84, an icon 75 of the hydraulic shovel 100 as seen from the side, the operability range 76 of the work machine 2, and information indicating the optimal work position. The design surface line 74 indicates a cross section of the design surfaces 45 apart from the target surface 70. The current surface line 78 indicates a cross section of the current surface described above. The target surface line 84 indicates a cross section of the target surface 70. As shown in FIG. 4, the design surface line 74 and the target surface line 84 are obtained by calculating an intersection 80 of the design land shape and a plane 77 passing through a current position of the tip P3 of the bucket 8. The target surface line 84 is displayed in a color different from that of the design surface line 74. In FIG. 5, different types of lines are used to represent the target surface line 84 and the design surface line 74. The operability range 76 indicates the range of the circumference around the main vehicle body 1 in which the work machine 2 can work. The operability range 76 is calculated from the work machine data described above. The method of calculating the operability range 76 will be described in detail hereafter. The optimal work position shown in the side view 52*b* is equivalent to the optimal work position displayed in the top view 52*a* described above, and is indicated by a triangular icon 81. The reference position of the main vehicle body 1 is indicated by a triangular icon 82. The operator moves the hydraulic shovel 100 so that the icon 82 for the reference position converges with the icon 81 for the optimal work position.

As described above, the guidance picture 52 includes information indicating the optimal work position and information for bringing the hydraulic shovel 100 directly face-to-face with the target surface 70. An operator is thereby capable of disposing the hydraulic shovel 100 in the optimal position and direction for performing work upon the target surface 70 using the guidance picture 52. Thus, the guidance picture 52 is primarily referred to in order to position the hydraulic shovel 100.

2-2 Method of Calculating Current Position of Tip of Bucket 8

As described above, the target surface line 84 is calculated based on the current position of the tip of the bucket 8. The positional guidance controller 39 calculates the current position of the tip P3 of the bucket 8 in a global coordinate system {X, Y, Z} based on the results detected by the three-dimensional position sensor 23, the first through third stroke sensors 16 to 18, the inclination angle sensor 24, and the like. Specifically, the current position of the tip P3 of the bucket 8 is obtained as follows.

Figure 6:
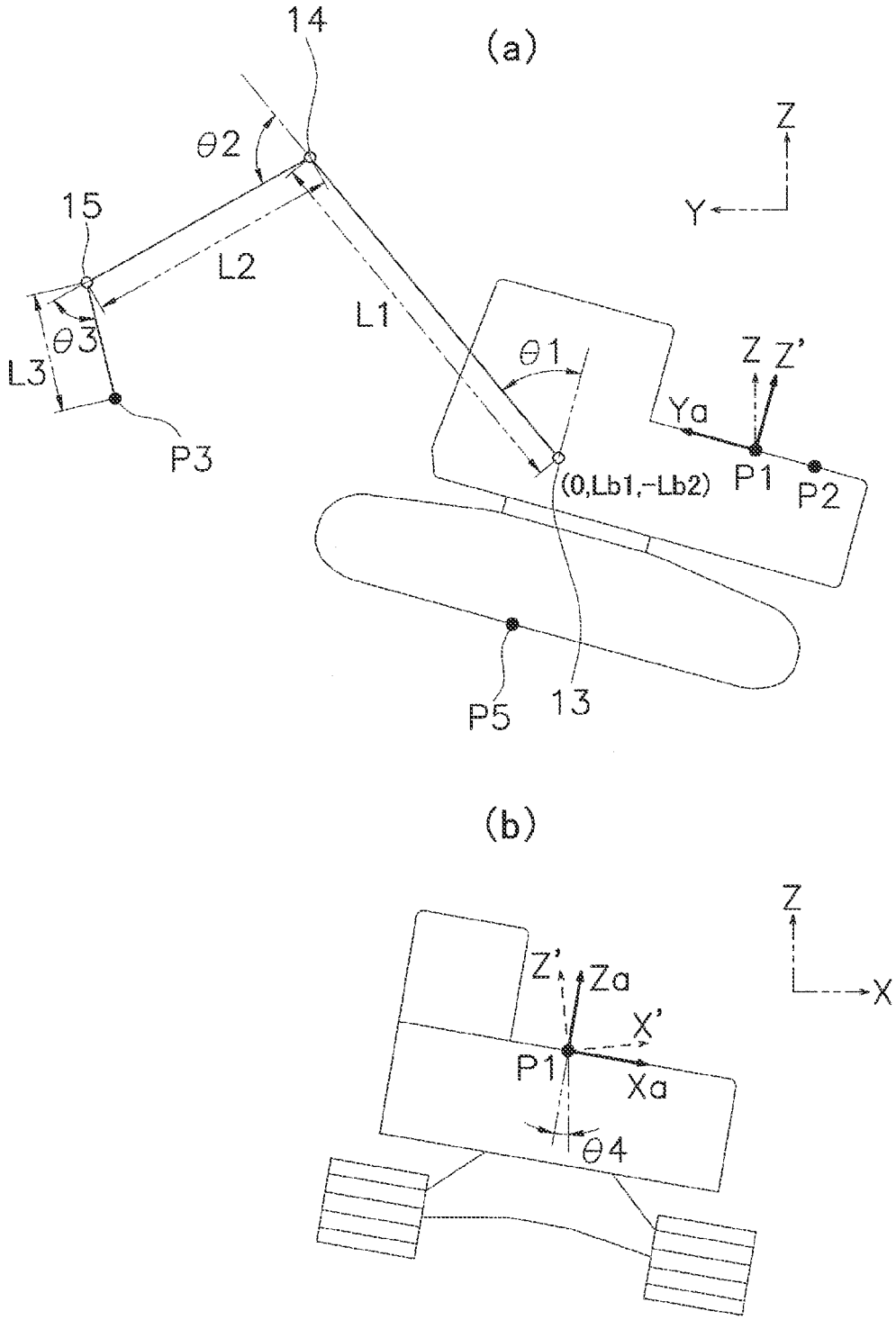
FIG. 6 shows a method of calculating the current position of the tip of a bucket.

First, as shown in FIG. 6, a main vehicle body coordinate system {Xa, Ya, Za} whose point of origin is the mounting position P1 of the GNSS antenna 21 described above is obtained. FIG. 6(*a*) is a side view of the hydraulic shovel 100. FIG. 6(*b*) is a rear view of the hydraulic shovel 100. Here, the front-back direction of the hydraulic shovel 100, i.e., the Ya axis direction of the main vehicle body coordinate system, is inclined with respect to the Y axis direction of the global coordinate system. The coordinates of the boom pin 13 in the main vehicle body coordinate system are (0, Lb1, −Lb2), and are stored in the work machine data storage unit 47 of the positional guidance controller 39 in advance.

The three-dimensional position sensor 23 detects the mounting positions P1, P2 of the GNSS antennas 21, 22. A unit vector for the Ya axis direction is calculated from the detected coordinate positions P1, P2 according to the following formula (1).

$$Ya=(P1-P2)/|P1-P2| \tag{1}$$

As shown in FIG. 6(*a*), introducing a vector Z" which is perpendicular to Ya and passes through the plane described by the two vectors Ya and Z, the following relationships are obtained.

$$(Z',Ya)=0 \tag{2}$$

$$Z'=(1-c)Z+cYa \tag{3}$$

In the above formula (3), c is a constant.

On the basis of formula (2) and (3), Z' is obtained by the following formula (4).

$$Z'=Z+\{(Z,Ya)/((Z,Ya)-1)\}(Ya-z) \tag{4}$$

Furthermore, define X' as a vector perpendicular to Ya and Z', X' is obtained in the following formula (5).

$$X'=Ya\perp Z' \tag{5}$$

As shown in FIG. 6(*b*), the main vehicle body coordinate system is rotated around the Ya axis by the roll angle θ4, and is thus shown as in the following formula (6).

$$[\,Xa\quad Ya\quad Za\,]=[\,X'\quad Ya\quad Z'\,]\begin{bmatrix}\cos\theta4 & 0 & \sin\theta4\\ 0 & 1 & 0\\ -\sin\theta4 & 0 & \cos\theta4\end{bmatrix} \tag{6}$$

The current angles of inclination θ1, θ2, θ3 of the boom 6, arm 7, and bucket 8, respectively as described above are calculated from the results detected by the first through third stroke sensors 16 to 18. The coordinates (xat, yat, zat) of the tip P3 of the bucket 8 in the main vehicle body coordinate system are calculated according to the following formulas (7) through (9) using the angles of inclination θ1, θ2, θ3 and the boom 6, arm 7, and bucket 8 lengths L1, L2, L3.

$$xat=0 \tag{7}$$

$$yat=Lb1+L1\sin\theta1+L2\sin(\theta1+\theta2)+L3\sin(\theta1+\theta2+\theta3) \tag{8}$$

$$zat=-Lb2+L1\cos\theta1+L2\cos(\theta1+\theta2)+L3\cos(\theta1+\theta2+\theta3) \tag{9}$$

The tip P3 of the bucket 8 moves over the plane Ya-Za in the main vehicle body coordinate system.

The coordinates of the tip P3 of the bucket 8 in the global coordinate system are obtained according to the following formula (10).

$$P3=xat\cdot Xa+yat\cdot Ya+zat\cdot Za+P1 \tag{10}$$

As shown in FIG. 4, the positional guidance controller 39 calculates, on the basis of the current position of the tip P3 of the bucket 8 calculated as described above and the design land shape data stored in the storage unit 43, the intersection 80 of the three-dimensional design land shape and the Ya-Za plane 77 through which the tip P3 of the bucket 8 passes. The positional guidance controller 39 displays the part of the intersection passing through the target surface 70 in the guidance picture 52 as the target surface line 84 described above.

The current surface detection unit 50 detects the current surface line 78 based on the path of movement of the bottom of the main vehicle body 1 and the path of movement of the tip P3 of the bucket 8. Specifically, the current surface detection unit 50 calculates the current position of a detection reference point P5 from the current position of the main vehicle body 1 (the mounting position P1 of the GNSS antenna 21), as shown in FIG. 6. The detection reference point P5 is positioned on the bottom surface of the tracks 5*a*, 5*b*. The current surface detection unit 50 stores the path of the detection reference point P5 in the current surface storage unit 48 as current surface data. Data indicating the positional relationship between the mounting position P1 of the GNSS antenna 21 and the detection reference point P5 is stored in advance in the current surface storage unit 48 described above. The path of the tip P3 of the bucket 8 is obtained by recording the current position of the tip P3 of the bucket 8 detected by the current position calculation unit 49 described above.

2-3. Method of Calculating Operability Range 76

Figure 7:
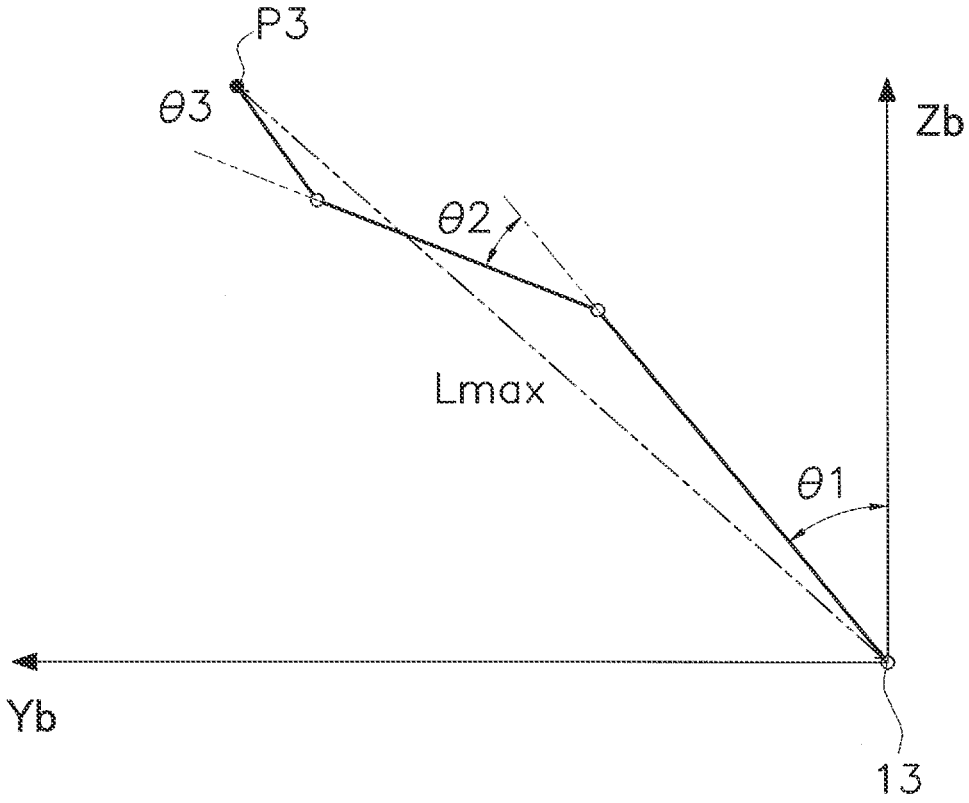
FIG. 7 is a schematic illustration of the work machine in a maximum reach posture.

First, before the method of calculating the operability range 76 is described, the maximum reach length Lmax and the minimum reach length Lmin of the work machine 2 is described. The maximum reach length Lmax is the reach length of the work machine 2 when the work machine 2 is maximally extended. The reach length of the work machine 2 is the distance between the boom pin 13 and the tip P3 of the bucket 8. FIG. 7 schematically illustrates the posture of the work machine 2 when the length of the work machine 2 is equivalent to the maximum reach length Lmax (hereafter, "maximum reach posture"). The origin of the coordinate plane Yb-Zb shown in FIG. 7 is the position of the boom pin 13 in the main vehicle body coordinate system {Xa, Ya, Za} described above. In the maximum reach posture, the arm angle θ2 is at the minimum value. The bucket angle θ3 is calculated using numerical analysis for parameter optimization so that the reach length of the work machine 2 is at the maximum. The value of the bucket angle θ3 at this time will be referred to hereafter as the "maximum reach angle".

Figure 8:
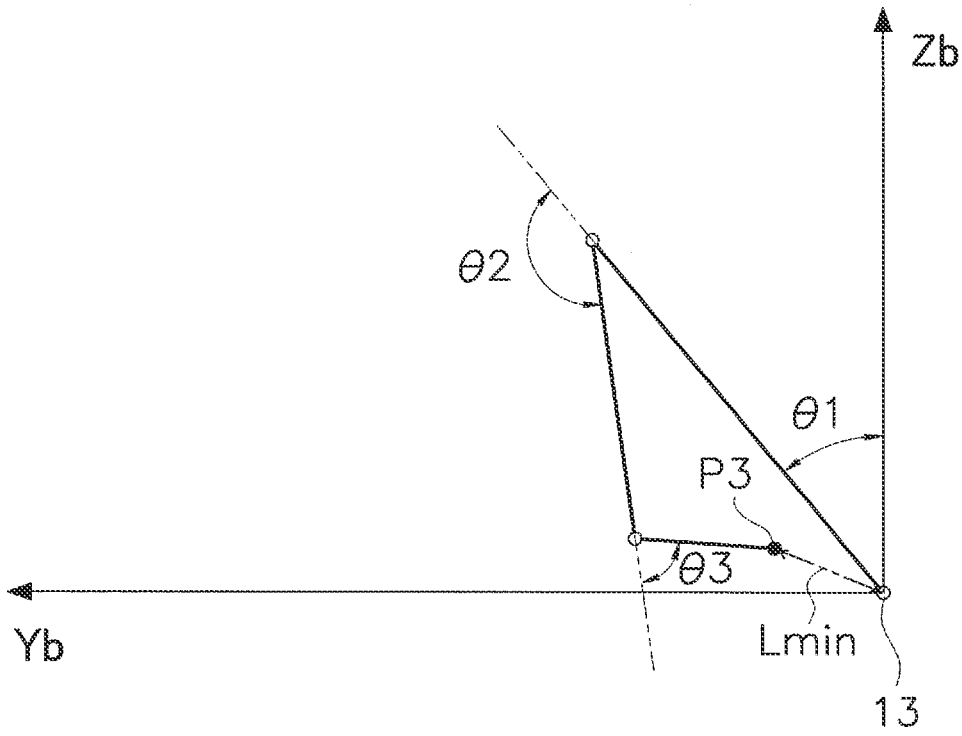
FIG. 8 is a schematic illustration of the work machine in a minimum reach posture.

The minimum reach length Lmin is the reach length of the work machine 2 when the work machine 2 is retracted to the smallest possible length. FIG. 8 schematically illustrates the posture of the machine 2 when the length of the work machine is equivalent to the minimum reach length Lmin (hereafter, "minimum reach posture"). In the minimum reach posture, the arm angle θ2 is at the maximum value. The bucket angle θ3 is calculated using numerical analysis for parameter optimization so that the reach length of the work machine 2 is at the minimum. The value of the bucket angle θ3 at this time will be referred to hereafter as the "minimum reach angle".

Figure 9:
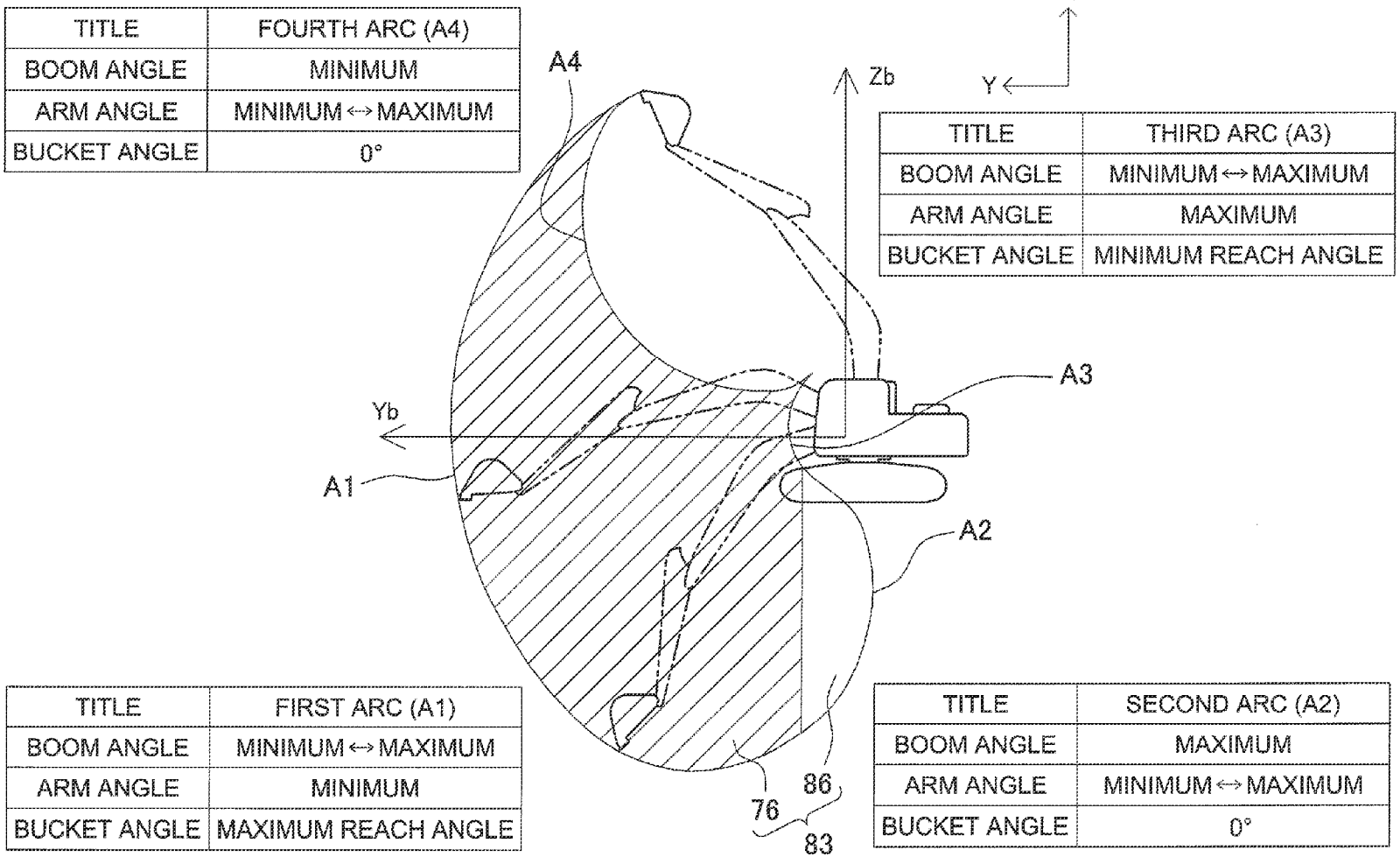
FIG. 9 is an illustration of a method of calculating an operability range.

Next, the method of calculating the operability range 76 will be described with reference to FIG. 9. The operability range is a range in which an underbody area 86 is excluded from a reachable range 83. The reachable range 83 is a range that can be reached by the work machine 2. The underbody area 86 is an area positioned underneath the main vehicle body 1. The reachable range 83 is calculated from the work machine data described above and the current position of the main vehicle body 1. The boundary of the reachable range 83 includes a plurality of arcs A1 to A4. For example, the boundary of the reachable range 83 includes a first arc A1 through a fourth arc A4. The first arc A1 is a path traced by the tip of the bucket 8 when the arm angle θ2 is at the minimum value, the bucket angle θ3 is at the maximum reach angle, and the boom angle θ1 varies between the minimum value and the maximum value. The second arc A2 is a path traced by the tip of the bucket 8 when the boom angle θ1 is at the maximum, the bucket angle θ3 is at 0°, and the arm angle θ2 varies between the minimum value and the maximum value. The third arc A3 is a path traced by the tip of the bucket 8 when the arm angle θ2 is at the maximum value, the bucket angle θ3 is at the minimum reach angle, and the boom angle θ1 varies between the minimum value and the maximum value. The fourth arc A4 is a path traced by the tip of the bucket 8 when the boom angle θ1 is at the minimum, the bucket angle θ3 is at 0°, and the arm angle θ2 varies between the minimum value and the maximum value.

2-4. Method of Calculating Optimal Work Position

Figure 11:
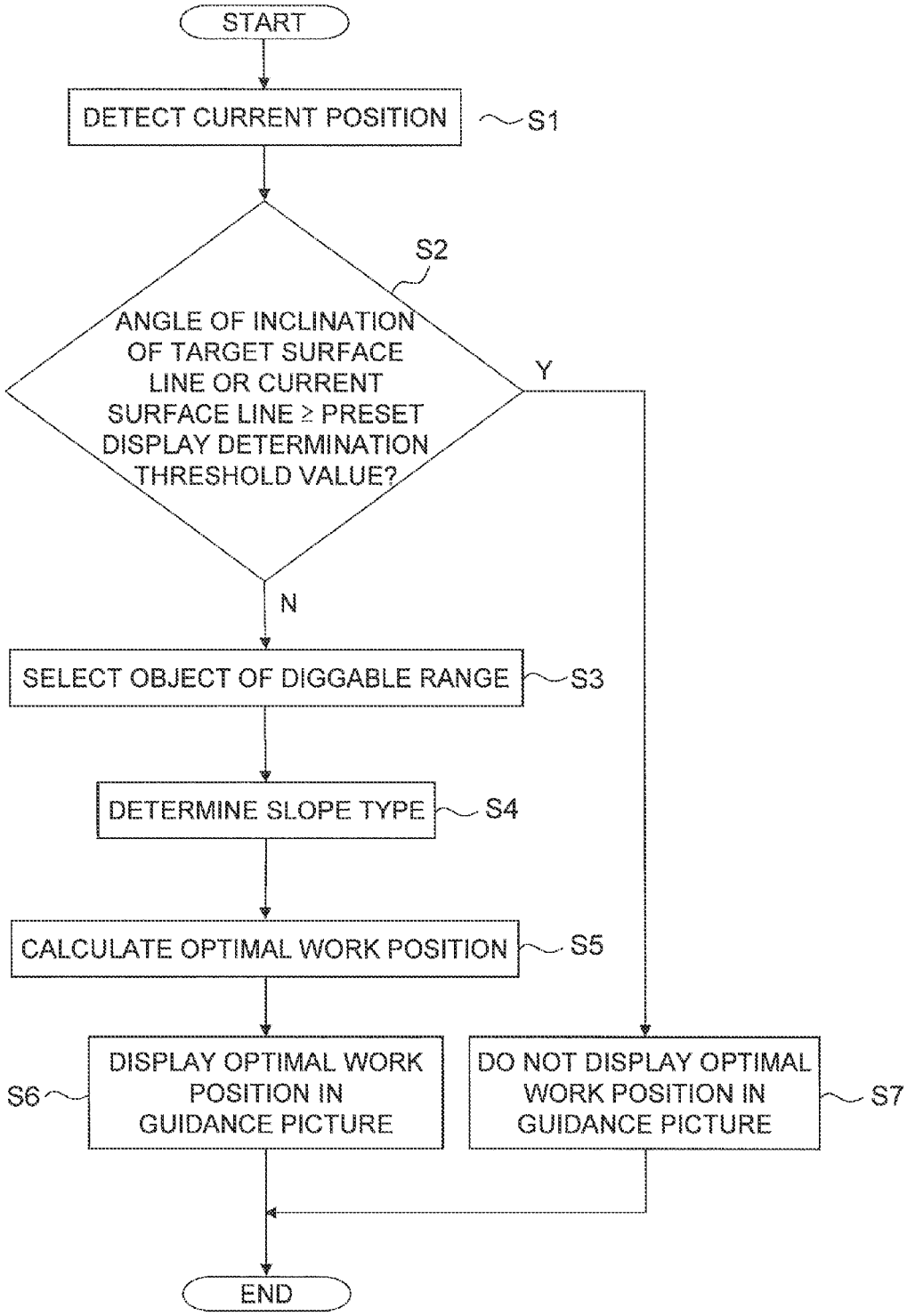
FIG. 11 is a flow chart showing a method of calculating an optimal work position.

Next, the method of calculating the optimal work position will be described. The optimal work position calculation unit 51 calculates the position of the main vehicle body 1 where a diggable range 79, in which the target surface 70 and the operability range 76 overlap, is largest as the optimal work position. The method of calculating the optimal work position will be described hereafter based on the flow chart shown in FIG. 11.

In step S1, the current position of the main vehicle body 1 is detected. Here, as described above, the current position calculation unit 49 calculates the current position of the main vehicle body 1 in the global coordinate system based on the detection signal from the position detector unit 19.

In step S2, it is determined whether the angle of inclination of the target surface line 84 or the current surface line 78 is at or above a preset display determination threshold value. The preset display determination threshold value is set to a slope angle indicating the limit at which the hydraulic shovel 100 is capable of stably performing work. The preset display determination threshold value is obtained in advance and stored in the work machine data storage unit 47. An angle of inclination θ5 of the target surface line 84 (cf. FIG. 10) is obtained from the design land shape data in the land shape data storage unit 46. An angle of inclination θ6 of the current surface line 78 (cf. FIG. 10) is obtained from the current surface data in the current surface storage unit 48. When at least one of the angle of inclination θ5 of the target surface line 84 and the angle of inclination θ6 of the current surface line 78 is equal to or more than the preset display determination threshold value, the optimal work position is not displayed in the guidance picture 52 in step S7. If neither the angle of inclination θ5 of the target surface line 84 nor the angle of inclination θ6 of the current surface line 78 is equal to or more than the preset display determination threshold value, the flow continues to step S3. In other words, if both the angle of inclination θ5 of the target surface line 84 and the angle of inclination θ6 of the current surface line 78 is less than the preset display determination threshold value, the flow continues to step 3.

Figure 10:
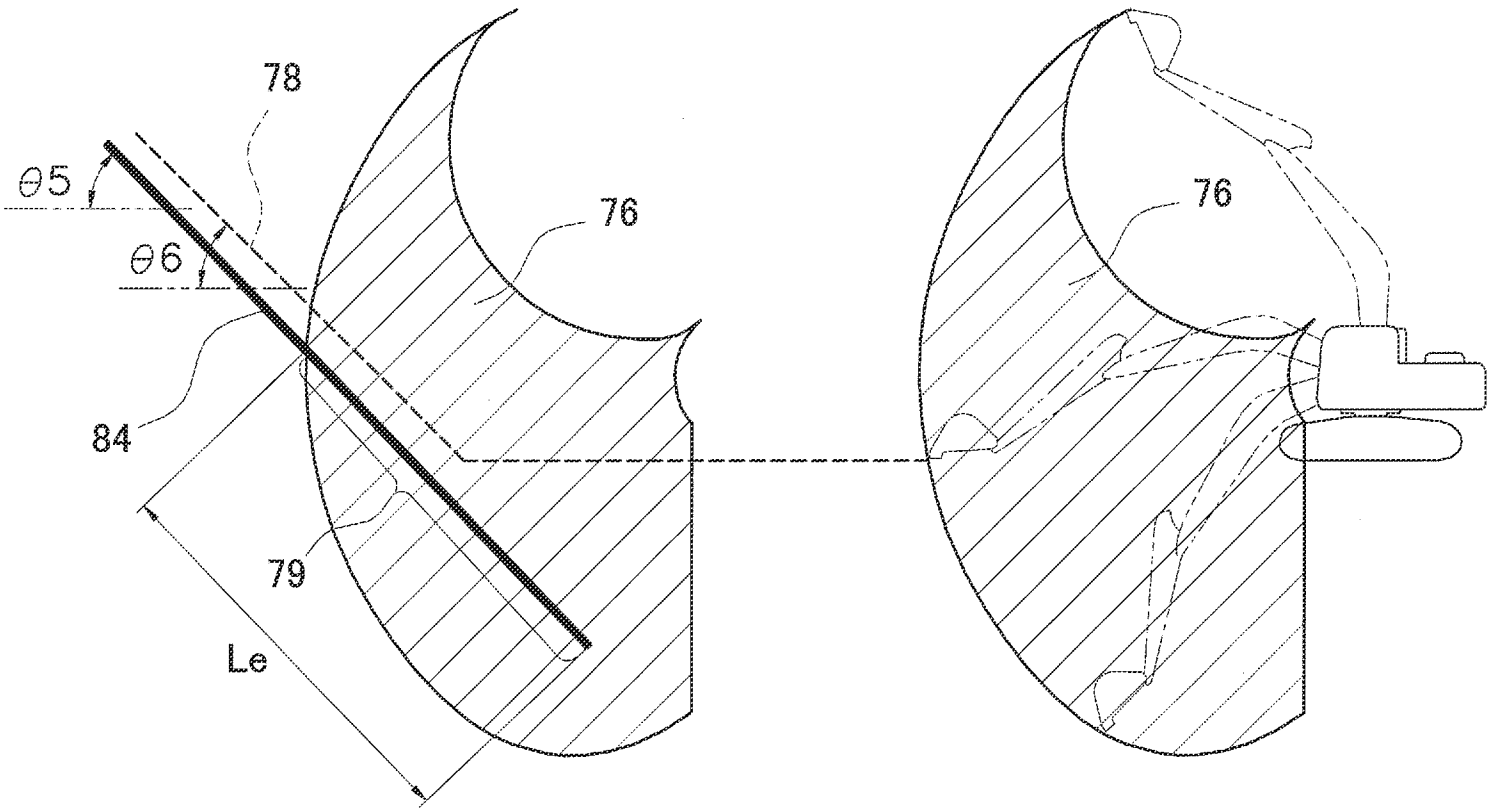
FIG. 10 is an illustration of a method of calculating an optimal work position.

In step S3, an object of diggable range is selected. As shown in FIG. 10, the diggable range 79 is a part where the target surface line 84 and the operability range 76 overlap as seen from the side. However, as shown in HG 12, the optimal work position calculation unit 51 classifies the target surface line 84 into a dug area and an undug area based on the distance G1 between the current surface line 78 and the target surface line 84. Specifically, the optimal work position calculation unit 51 classifies a part of the target surface line 84 in which the distance G1 from the current surface line equal to or more than a preset classification determination threshold value Gth as the undug area. The optimal work position calculation unit 51 classifies a part of the target surface line 84 in which the distance G1 from the current surface line 78 is less than a preset classification determination threshold value Gth as the dug area. The optimal work position calculation unit 51 determines the undug area nearest the main vehicle body 1 as the object of the diggable range 79.

In step S4, slope type is determined. At this point, it is determined whether the target surface 70 is an upward slope, a level surface, or a downward slope as seen from the hydraulic shovel. The optimal work position calculation unit 51 determines slope type based on the design land shape data in the land shape data storage unit 46 and the current position of the main vehicle body 1.

In step S5, the optimal work position is calculated. At this point, as shown in FIG. 10, a position of the main vehicle body 1 where the length Le of the diggable range 79, in which the target surface line 84 and the operability range 76 overlap, is largest is calculated as the optimal work position. However, a position where the length Le of the diggable range 79 within the area that is the object of the diggable range 79 selected in step S3 is largest is calculated.

Figure 13:
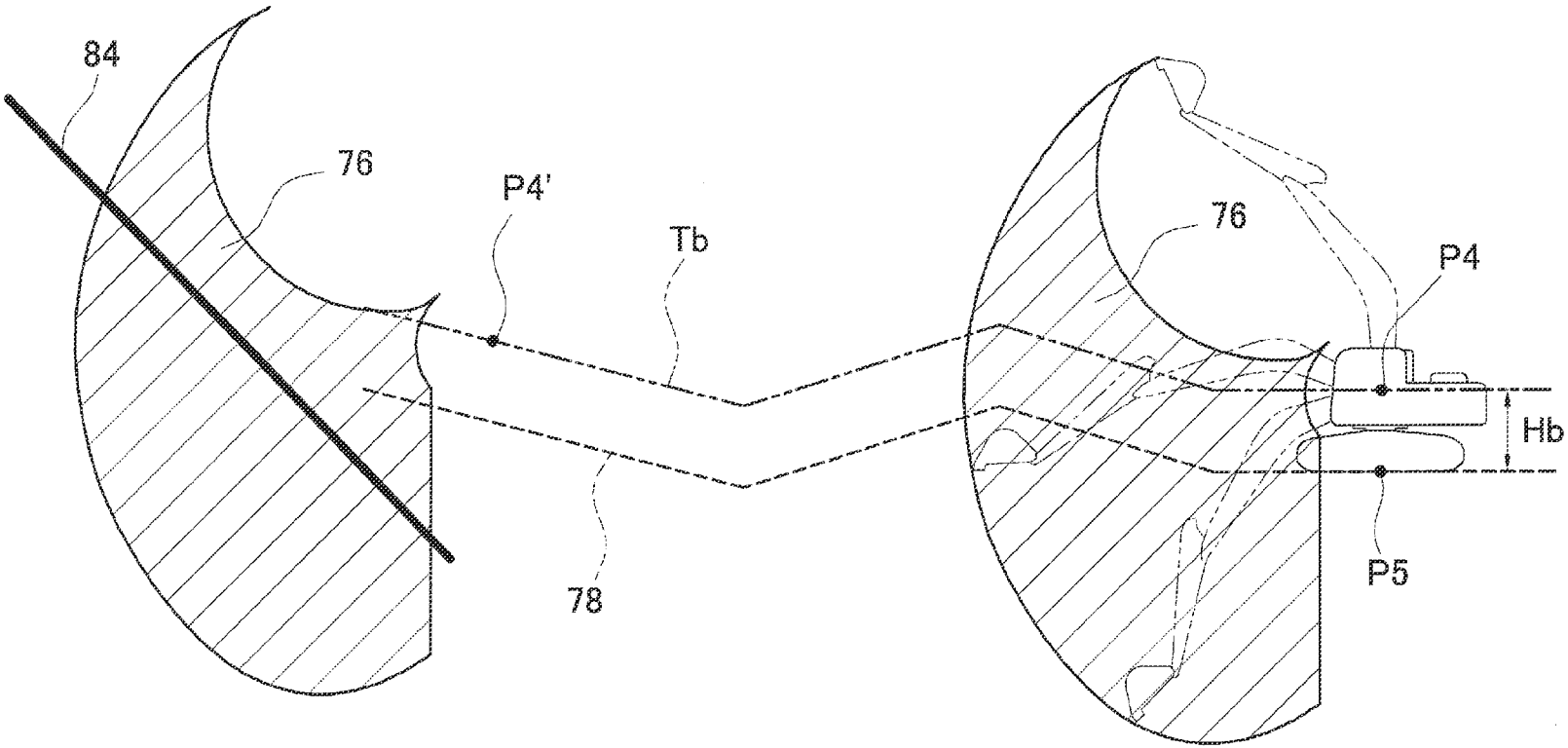
FIG. 13 is an illustration of a method of calculating an optimal work position.

The optimal work position is calculated based on the height of the operability range 76 as the main vehicle body 1 is positioned on the current surface line 78. Specifically, as shown in FIG. 13, the current position 14 of the boom pin 13 when the main vehicle body 1 is apart from the target surface line 84 and the position P4' of the boom pin 13 when the main vehicle body 1 is positioned near the target surface line 84 differ according to the shape of the current surface line 78. For this reason, the height of the operability range 76 also varies as the height of the current surface line 78 varies. Thus, the optimal work position is calculated based on the height of the operability range 76 according to the current surface line 78. Specifically, data indicating the height Hb to the boom pin 13 from the detection reference point P5 on the bottom surface of the tracks 5*a*, 5*b* is stored in the work machine data storage unit 47, and a position higher than the current surface line 78 by the height Hb of the boom pin 13 is calculated as the path Tb of the boom pin 13 as the main vehicle body 1 is positioned on the current surface line 78. The optimal work position is calculated, based on the operability range 76 as the boom pin 13 moves along the path Tb.

Figure 14:
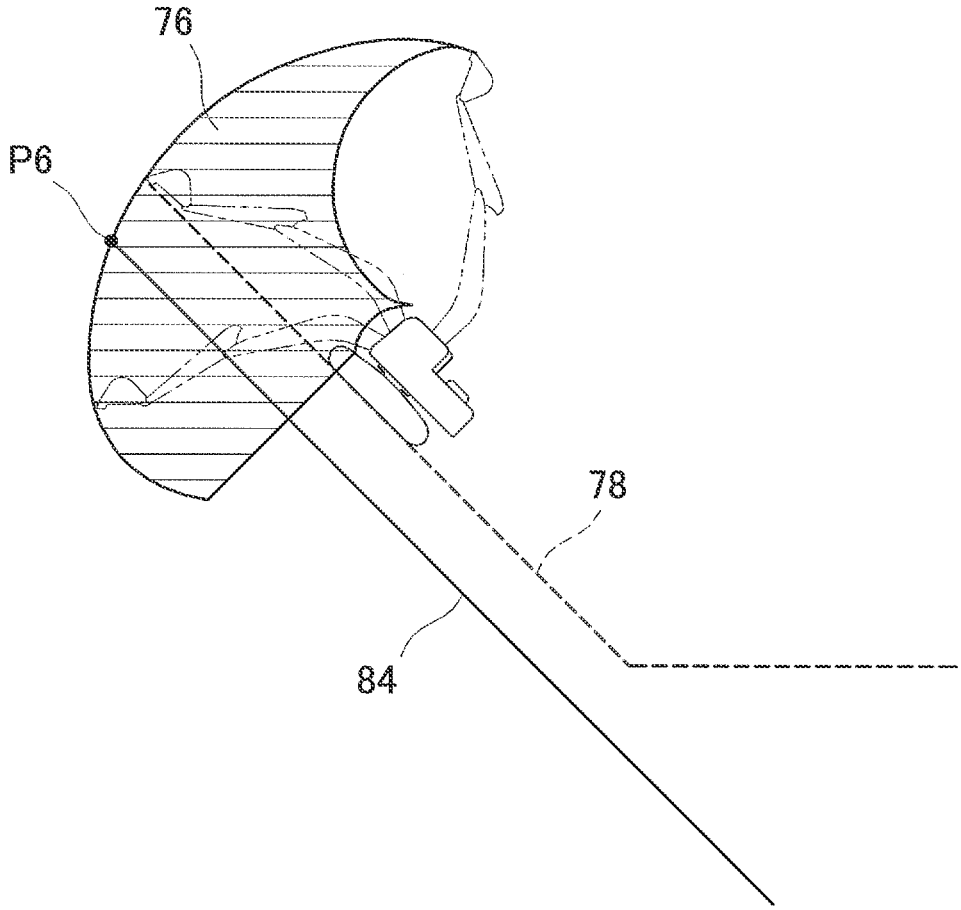
FIG. 14 is an illustration of a method of calculating an optimal work position on an upward slope.
Figure 15:
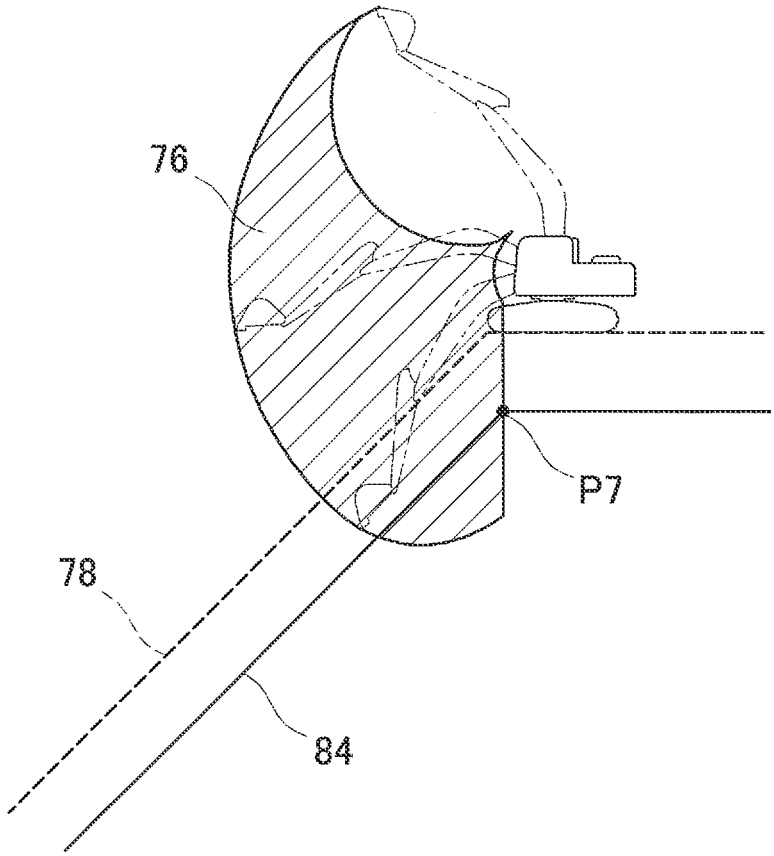
FIG. 15 is an illustration of a method of calculating an optimal work position on a downward slope.

In step S4 described above, when the target surface 70 is determined as an upward slope or a level surface, as shown in FIG. 14, a position where a farthest intersection P6 from the main vehicle body 1 among intersections of the boundary of the operability range 76 and the target surface line 84 corresponds to the position of the top of the target surface line 84 is calculated as the optimal work position. When the target surface 70 is determined as a downward slope in step S4, as shown in FIG. 15, a position where a nearest intersection P7 to the main vehicle body 1 among intersections of the boundary of the operability range 76 and the target surface line 84 corresponds to the position of the top of the target surface line 84 is calculated as the optimal work position.

In step S6, the guidance picture 52 showing the optimal work position is displayed on the display unit 42. At this time, as shown in FIG. 5, the straight line 72 showing the optimal work position is displayed in the top view 52*a* of the guidance picture 52. The triangular icon 81 showing the optimal work position is displayed in the side view 52*b* of the guidance picture 52.

3. Characteristics

In the positional guidance system 28 of the hydraulic shovel 100 according to the present embodiment, the position of the main vehicle body 1 where the diggable range 79, in which the target surface line 84 and the operability range 76 overlap, is largest is calculated as the optimal work position. The guidance picture 52 showing the optimal work position is then displayed on the display unit 42. Accordingly, an operator can easily move the hydraulic shovel 100 to a position suitable for performing digging work by steering the hydraulic shovel 100 towards the optimal work position shown in the guidance picture 52. Specifically, an operator can find the optimal work position using the icon 81 displayed in the side view 52*b* of the guidance picture 52 shown in FIG. 5. An operator is thus capable of easily adjusting the forward/backward position of the hydraulic shovel 100. The operator can also find the optimal work position using the straight line 72 displayed in the top view 52*a* of the guidance picture 52. An operator is thus capable of easily adjusting the left/right position of the hydraulic shovel 100.

As shown in FIG. 13, the optimal work position is calculated based on not the height of the operability range 76 at the current position of the main vehicle body 1, but the height of the operability range 76 as the main vehicle body 1 is positioned on the current surface line 78. It is thereby possible to precisely calculate the optimal work position even in a rough work area.

Figure 12:
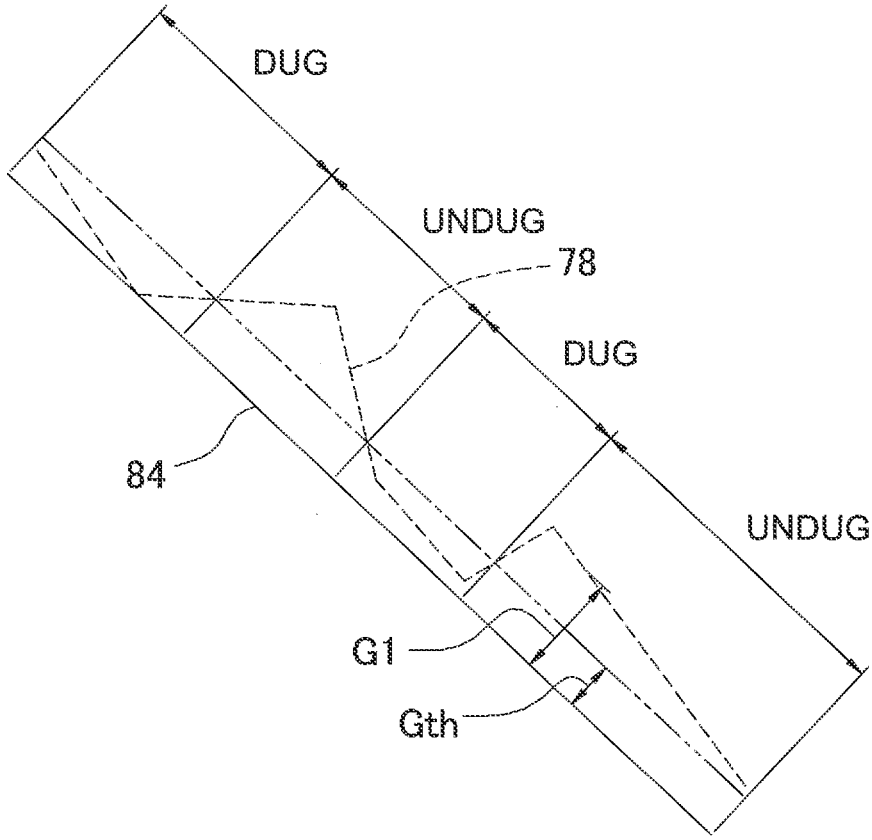
FIG. 12 is an illustration of a method of classifying an undug area and a dug area.

The target surface line 84 is classified into an undug area and a dug area, and the undug area is set as the object of the diggable range 79. It is thereby possible to exclude the dug area, which no longer needs to be dug, when the optimal work position is calculated even in a case that the undug area and the dug area are mixed due to intermittent digging, as shown in FIG. 12. It is thereby possible to precisely calculate an effective optimal work position.

When the angle of inclination θ5 of the target surface line 84 or the angle of inclination θ6 of the current surface line 78 is equal to or more than the preset determination threshold value, the optimal work position is not displayed in the guidance picture 52. It is thereby possible to show in the guidance picture 52 an optimal work position within the range where the hydraulic shovel 100 is capable of stably performing work.

When the target surface 70 is an upward slope or a level surface as seen from the hydraulic shovel 100, as shown in FIG. 14, a position where the work machine 2 can extend to reach the top of the target surface line 84 is calculated as the optimal work position. An operator is thereby capable of operating the hydraulic shovel 100 so as, for example, to descend the upward slope while digging is performed downwards from the top when the upward slope is much larger than the hydraulic shovel 100.

When the target surface 70 is a downward slope as seen from the hydraulic shovel 100, as shown in FIG. 15, a position where the work machine 2 can retract to reach the top of the target surface line 84 is calculated as the optimal work position. An operator is thereby capable of operating the hydraulic shovel 100 so as, for example, to descend the downward slope while digging the area in front of the vehicle body 1.

4. Other Embodiments

An embodiment of the present invention has been described above, but the present invention is not limited to this embodiment, and a variety of modifications are possible to the extent that they remain within the spirit of the invention. For example, part or all of the functions of the positional guidance system 28 may be executed by a computer disposed outside the hydraulic shovel 100. In the embodiment described above, the work machine 2 has a boom 6, an arm 7, and a bucket 8, but the configuration of the work machine 2 is not limited thereto.

In the embodiment described above, the angles of inclination of the boom 6, the arm 7, and the bucket 8 are detected by the first through third stroke sensors 16 to 18, but the means for detecting the angles of inclination is not limited thereto. For example, an angle sensor for detecting the angles of inclination of the boom 6, the arm 7, and the bucket 8 may be provided.

In the embodiment described above, the path of the positions of the tip P3 of the bucket 8 and the path of the positions of the detection reference point P5 on the bottom surface of the tracks 5*a*, 5*b* are detected as the current surface line 78. However, the method of detecting the current surface line 78 is not limited thereto. For example, the current surface line 78 may be detected using a laser distance-measuring apparatus, as disclosed in Japanese Laid Open Patent Application Publication 2002-328022. Alternatively, the current surface line 78 may be detected using a stereo camera measuring apparatus, as disclosed in Japanese Laid-Open Patent Application Publication H11-211473.

Figure 16:
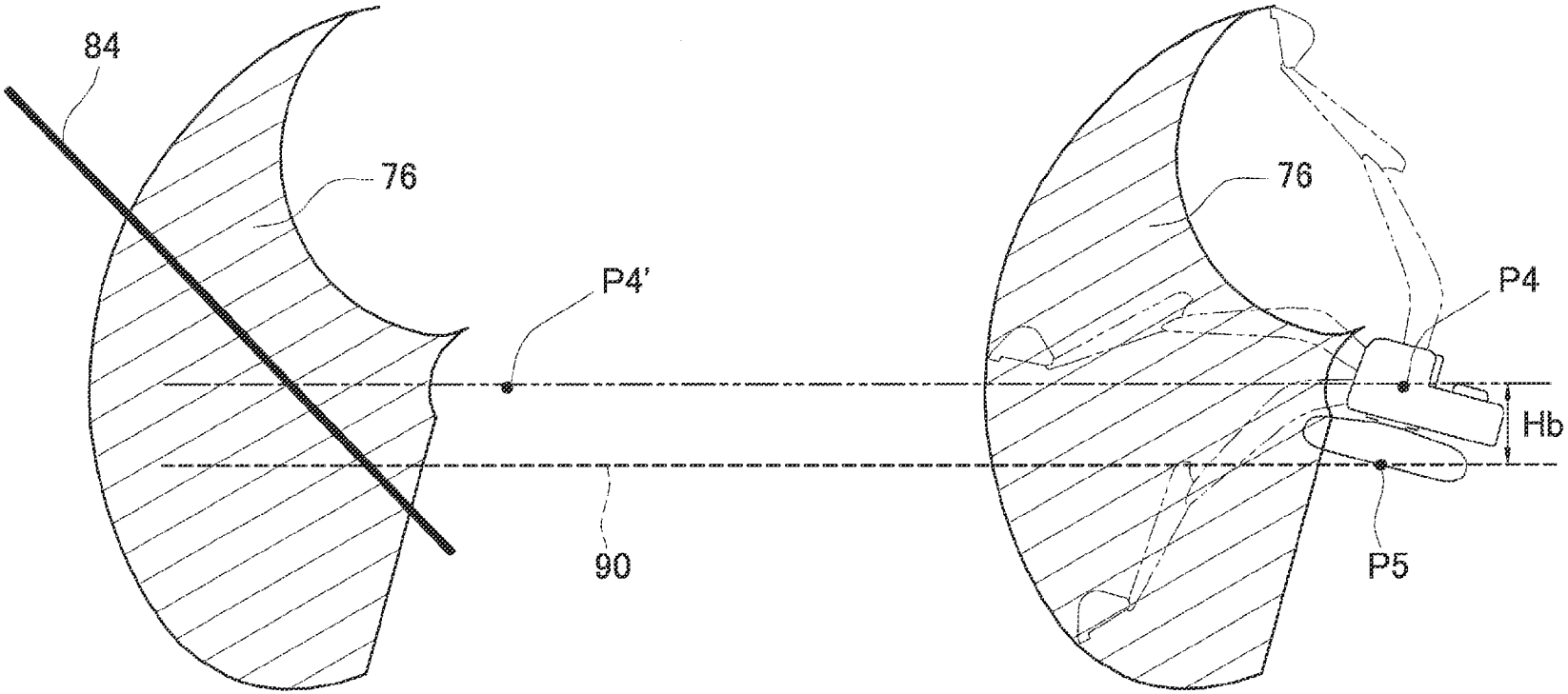
FIG. 16 is an illustration of a method of calculating an optimal work position according to another embodiment.

In the embodiment described above, as shown in FIG. 13, the optimal work position is calculated based on the height of the operability range 76 according to the current surface line 78. However, the optimal work position may also be calculated based on the height of the operability range 76 from an imaginary ground line 90, as shown in FIG. 16. The imaginary ground line 90 is a line passing through the detection reference point P5 on the bottom surface at the current position of the hydraulic shovel 100 and parallel to the Y-axis direction in the global coordinate system.

The illustrated embodiment has the effect of allowing a hydraulic shovel to be easily moved to a position suitable for performing work, and is useful as a hydraulic shovel positional guidance system and a method of controlling the same.

The invention claimed is:

1. A positional guidance system for guiding a hydraulic shovel to a target surface within a work area, the hydraulic shovel including a main vehicle body and a work machine attached to the main vehicle body, the positional guidance system comprising:

a land shape data storage unit configured and arranged to store land shape data indicating a position of the target surface;

a work machine data storage unit configured and arranged to store work machine data indicating an operability range around the main vehicle body to which the work machine is capable of reaching;

a position detector unit configured and arranged to detect a current position of the main vehicle body;

an optimal work position calculation unit configured to calculate an optimal work position of the main vehicle body where a diggable range, in which the target surface and the operability range overlap, is largest, based on the land shape data, the work machine data, and the current position of the main vehicle body; and a display unit configured and arranged to display a guidance picture showing the optimal work position.

2. The positional guidance system for the hydraulic shovel according to claim 1, wherein the diggable range is a part where the operability range and a line showing a cross section of the target surface overlap as seen from a side of the main vehicle body.

3. The positional guidance system for the hydraulic shovel according to claim 1, wherein the guidance picture includes a side view showing a cross section of the target surface, the hydraulic shovel, and the optimal work position as seen from a side of the main vehicle body.

4. The positional guidance system for the hydraulic shovel according to claim 1, wherein the guidance picture includes a top view showing the target surface, the hydraulic shovel, and the optimal work position as seen from above.

5. The positional guidance system for the hydraulic shovel according to claim 1, further comprising:

a current surface detection unit configured and arranged to detect a latest current surface; and a current surface storage unit configured and arranged to store and update the latest current surface detected by the current surface detection unit, wherein the optimal work position is calculated based on a height of the operability range as the main vehicle body is positioned on the current surface.

6. The positional guidance system for the hydraulic shovel according to claim 1, further comprising:

a current surface detection unit configured and arranged to detect a latest current surface; and a current surface storage unit configured and arranged to store and update the latest current surface detected by the current surface detection unit, wherein the optimal work position calculation unit is configured to classify the target surface into a dug area and an undug area based on a degree of a gap between the current surface and the target surface, and to set the undug area nearest the main vehicle body as the diggable range.

7. The positional guidance system for the hydraulic shovel according to claim 1, wherein the optimal work position calculation unit is configured to cause the guidance picture to show the optimal work position when an angle of inclination of a current surface or the target surface is equal to or more than a preset threshold value.

8. The positional guidance system for the hydraulic shovel according to claim 1, wherein the optimal work position is a position such that, when the target surface is an upward slope or a level surface as seen from the hydraulic shovel, an intersection farthest from the main vehicle body among intersections of a boundary of the operability range and the target surface corresponds to a top of the target surface.

9. The positional guidance system for the hydraulic shovel according to claim 1, wherein the optimal work position is a position such that, when the target surface is a downward slope as seen from the hydraulic shovel, an intersection nearest to the main vehicle body among intersections of a boundary of the operability range and the target surface corresponds to a top of the target surface.

10. A hydraulic shovel comprising the positional guidance system for the hydraulic shovel according to claim 1.

11. A method for controlling a positional guidance system for guiding a hydraulic shovel to a target surface within a work area, the hydraulic shovel including a main vehicle body and a work machine attached to the main vehicle body, the method comprising:

detecting a current position of the main vehicle body;

calculating an optimal work position of the main vehicle body where a diggable range, in which a target surface and an operability range around the main vehicle body to which the work machine is capable of reaching overlap, is largest, based on land shape data indicating a position of the target surface, work machine data indicating the operability range, and the current position of the main vehicle body; and displaying a guidance picture showing the optimal work position.

* * * * *